US009162849B2

(12) United States Patent
Mitsui

(10) Patent No.: US 9,162,849 B2
(45) Date of Patent: Oct. 20, 2015

(54) ELEVATOR ROPE

(75) Inventor: Atsushi Mitsui, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/362,794

(22) PCT Filed: Jan. 23, 2012

(86) PCT No.: PCT/JP2012/051313

§ 371 (c)(1),
(2), (4) Date: Jun. 4, 2014

(87) PCT Pub. No.: WO2013/111260

PCT Pub. Date: Aug. 1, 2013

(65) Prior Publication Data

US 2014/0311119 A1 Oct. 23, 2014

(51) Int. Cl.

| | |
|---|---|
| ***B66B 7/06*** | (2006.01) |
| ***D07B 1/08*** | (2006.01) |
| ***D07B 1/06*** | (2006.01) |
| ***D07B 1/16*** | (2006.01) |
| *D07B 1/14* | (2006.01) |

(52) U.S. Cl.

CPC . *B66B 7/06* (2013.01); *D07B 1/068* (2013.01); *D07B 1/08* (2013.01); *D07B 1/165* (2013.01); *D07B 1/144* (2013.01); *D07B 2201/102* (2013.01); *D07B 2201/1016* (2013.01); *D07B 2201/1036* (2013.01); *D07B 2201/1076* (2013.01); *D07B 2201/2057* (2013.01); *D07B 2201/2073* (2013.01); *D07B 2201/2074* (2013.01); *D07B 2205/201* (2013.01)

(58) Field of Classification Search

CPC ..... D07B 1/06; D07B 1/08; D07B 1/0613; D07B 1/0673; D07B 2205/3025; D07B 2501/2007; B66B 7/06

USPC ..... 57/214, 216, 218

See application file for complete search history.

(56) References Cited

U.S. PATENT DOCUMENTS 1,811,697 A * 6/1931 Reilly ..... 57/214
2,241,955 A * 5/1941 Noyer et al. ..... 57/214

(Continued)

FOREIGN PATENT DOCUMENTS

CN 101481886 A 7/2009
JP 60-82495 6/1985

(Continued)

OTHER PUBLICATIONS

International Search Report issued May 1, 2012, in PCT/JP2012/051313, filed Jan. 23, 2012.

(Continued)

*Primary Examiner* — Shaun R Hurley

(74) *Attorney, Agent, or Firm* — Oblon, McClelland, Maier & Neustadt, L.L.P.

(57) ABSTRACT

In an elevator rope, a plurality of steel outer layer strands are twisted together on an outer circumference of an inner layer rope. The inner layer rope has: a fiber core; a plurality of steel inner layer strands that are twisted together directly onto an outer circumference of the fiber core; and a resin inner layer rope coating body that is coated onto the outer circumference. A diameter of the inner layer strands is smaller than a diameter of the outer layer strands. The inner layer strands are greater in number than the outer layer strands.

9 Claims, 3 Drawing Sheets

(56) References Cited

U.S. PATENT DOCUMENTS

| | | | | |
|---|---|---|---|---|
| 3,104,515 | A * | 9/1963 | Stevens | 57/220 |
| 3,822,542 | A * | 7/1974 | Naud et al. | 57/215 |
| 3,874,158 | A * | 4/1975 | Chiappetta et al. | 57/214 |
| 4,219,995 | A * | 9/1980 | Tajima et al. | 57/220 |
| 4,226,078 | A * | 10/1980 | Ohta et al. | 57/213 |
| 4,487,010 | A * | 12/1984 | Chiappetta et al. | 57/213 |
| 4,514,058 | A * | 4/1985 | Walton | 385/107 |
| 6,412,264 | B1 * | 7/2002 | De Josez et al. | 57/217 |
| 6,563,054 | B1 * | 5/2003 | Damien et al. | 174/120 C |
| 2004/0016603 | A1 | 1/2004 | Aulanko et al. | |
| 2004/0026178 | A1 * | 2/2004 | Honda | 187/251 |
| 2008/0236130 | A1 * | 10/2008 | Furukawa et al. | 57/212 |
| 2011/0192131 | A1 * | 8/2011 | Naito et al. | 57/232 |
| 2012/0180926 | A1 * | 7/2012 | Rebouillat et al. | 152/527 |

FOREIGN PATENT DOCUMENTS

| | | |
|---|---|---|
| JP | 07-070962 | 3/1995 |
| JP | 07-043870 | 9/1995 |
| JP | 08-074190 | 3/1996 |
| JP | 2992783 | 12/1999 |
| JP | 2006-009174 | 1/2006 |
| WO | 2008/023434 | 2/2008 |
| WO | 2010/143249 | 12/2010 |

OTHER PUBLICATIONS

U.S. Appl. No. 14/414,264, filed Jan. 12, 2015, Mitsui.

Office Action issued Jun. 3. 2015 in Chinese Patent Application No. 201280067339.2 (with English translation).

Extended European Search Report issued Jul. 31, 2015 in Patent Application No. 12866434.9.

* cited by examiner

ELEVATOR ROPE

TECHNICAL FIELD

The present invention relates to an elevator rope that has: a fiber core that is disposed centrally; and a plurality of strands that are formed by twisting together a plurality of steel wires.

BACKGROUND ART

In conventional elevator ropes, a core rope is disposed centrally. The core rope is configured by twisting three core rope strands together with each other. Each of the core rope strands is constituted by a number of yarns that are formed by bundling fibers. An outer circumference of the core rope is coated by a resin core rope coating body. A plurality of steel strands are twisted together on an outer circumference of the core rope coating body. Each of the steel strands is formed by twisting together a plurality of steel wires (see Patent Literature 1, for example).

CITATION LIST

Patent Literature

[Patent Literature 1]
International Publication No. (WO) 2010/143249

SUMMARY OF THE INVENTION

Problem to be Solved by the Invention

In conventional wire ropes such as that described above, because the core rope is constituted by fibers, there has been a risk that the fibers may melt and break due to heat from a molding machine as the core rope coating body is coated onto the outer circumference of the core rope. Furthermore, because the core rope is not tightened except during the step of twisting the core rope strands together, structural gaps remain inside the core rope, giving rise to deformation (loss of resilience) and reductions in diameter in the core rope due to extensive use, and contact pressure among the steel strands is thereby increased, giving rise to abrasion and wire breakages in the steel wires. In addition, if a rope grease is impregnated into the core rope, then it is desirable to maximize cross-sectional area of the core rope in order to ensure sufficient rope grease content.

The present invention aims to solve the above problems and an object of the present invention is to provide an elevator rope that can extend service life further by suppressing breakage of fibers that constitute a fiber core, and deformation and reductions in diameter of the fiber core, while ensuring sufficient cross-sectional area in the fiber core.

Means for Solving the Problem

In order to achieve the above object, according to one aspect of the present invention, there is provided an elevator rope including: an inner layer rope that includes: a fiber core; a plurality of steel inner layer strands that are twisted together on an outer circumference of the fiber core; and a resin inner layer rope coating body that is coated onto an outer circumference; and a plurality of steel outer layer strands that are twisted together on an outer circumference of the inner layer rope, wherein: a diameter of the inner layer strands is smaller than a diameter of the outer layer strands, and the inner layer strands are greater in number than the outer layer strands.

Effects of the Invention

In an elevator rope according to the present invention, because the inner layer strands have a smaller diameter than the outer layer strands, sufficient cross-sectional area of the fiber core can be ensured, and because the inner layer strands, which are greater in number than outer layer strands, are disposed on the outer circumference of the fiber core, the fiber core is protected by the inner layer strands during molding of the inner layer rope coating body, suppressing breakage of the fibers of the fiber core, and in addition, because the fiber core is tightened when the inner layer strands are twisted together, deformation and reductions in diameter of the fiber core due to extended periods of use are suppressed, enabling additional extension of service life to be achieved.

DESCRIPTION OF EMBODIMENTS

Preferred embodiments of the present invention will now be explained with reference to the drawings.

Embodiment 1

Figure 1:
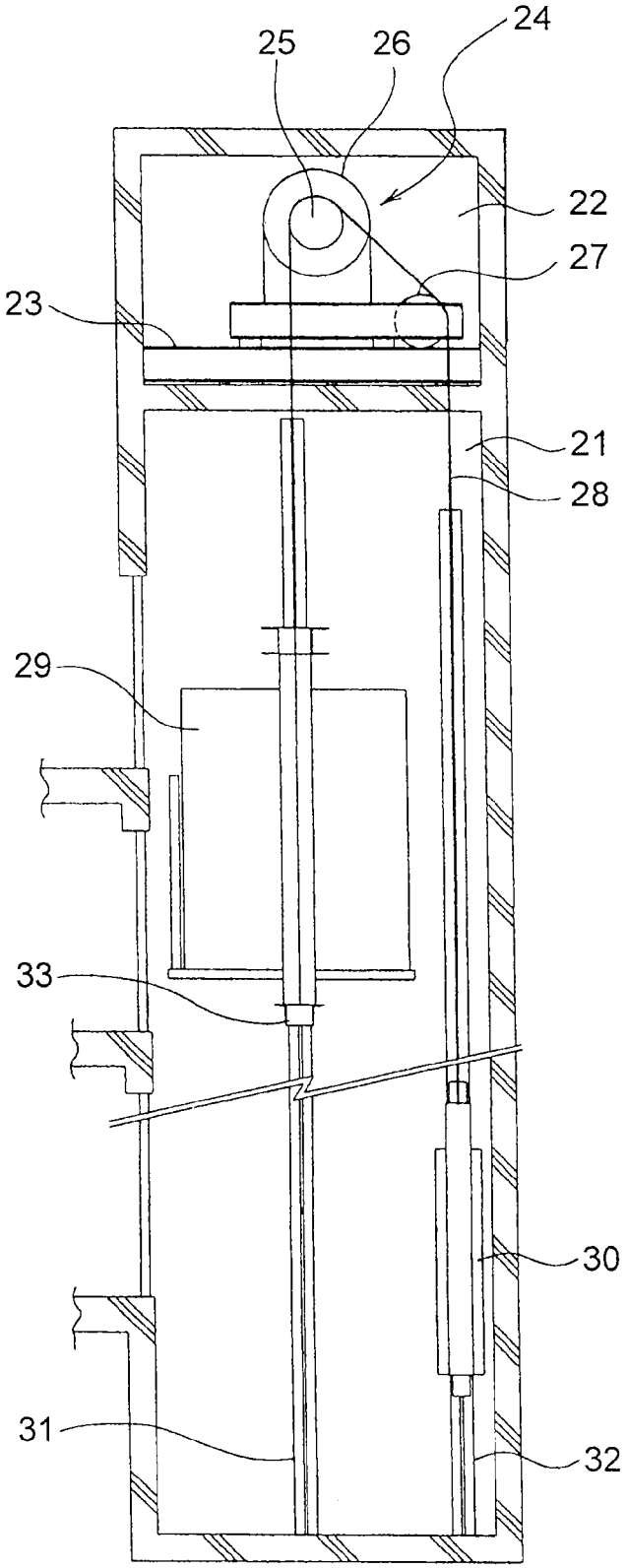
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 22 is disposed in an upper portion of a hoistway 21. A machine base 23 is installed inside the machine room 22. A hoisting machine 24 is supported on the machine base 23. The hoisting machine 24 has a sheave 25 and a hoisting machine main body 26. The hoisting machine main body 26 has: a hoisting machine motor that rotates the sheave 25; and a hoisting machine brake that brakes the rotation of the sheave 25.

A deflecting sheave 27 is mounted onto the machine base 23. A plurality of elevator ropes 28 (only one is shown in the figure) that function as a suspending body are wound around the sheave 25 and the deflecting sheave 27. Rope grooves into which the elevator ropes 28 are inserted are formed on an outer circumference of the sheave 25.

A car 29 and a counterweight 30 are suspended inside the hoistway 21 by the elevator ropes 28 so as to be raised and lowered inside the hoistway 21 by the hoisting machine 24. A pair of car guide rails 31 that guide raising and lowering of the car 29 and a pair of counterweight guide rails 32 that guide raising and lowering of the counterweight 30 are installed inside the hoistway 21. A safety device 33 that makes the car 29 perform an emergency stop by engaging with the car guide rail 31 is mounted onto the car 29.

Figure 2:
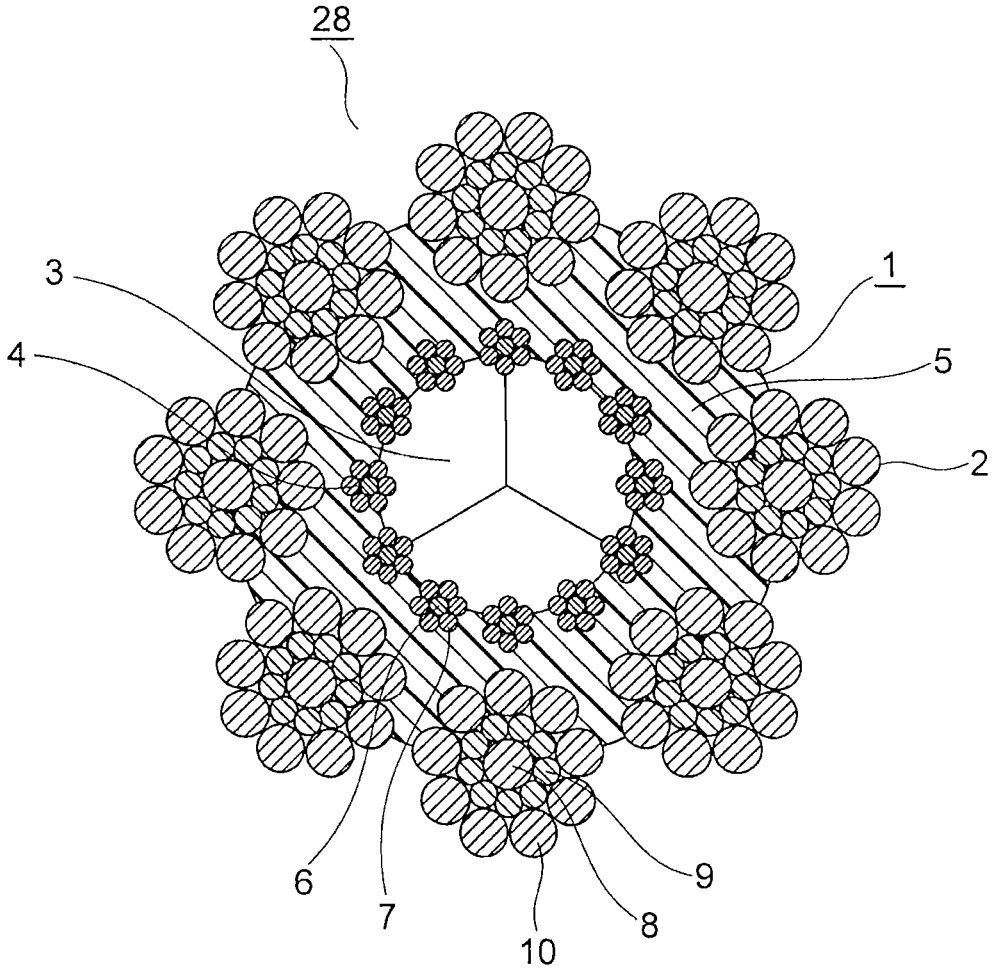
FIG. 2 is a cross section of an elevator rope from FIG. 1.

FIG. 2 is a cross section of an elevator rope 28 from FIG. 1. The elevator rope 28 has: an inner layer rope 1; and a plurality of outer layer strands 2 that are twisted together on an outer circumference of the inner layer rope 1. The outer layer strands 2 are positioned in an outermost layer of the elevator rope 28 so as to be exposed externally.

The inner layer rope 1 has: a fiber core 3 that is disposed centrally; a plurality of inner layer strands 4 that are twisted together directly onto an outer circumference of the fiber core 3; and a resin inner layer rope coating body 5 that is coated onto an outer circumference.

A synthetic fiber round bar core (a solid core) that is made of polypropylene or polyethylene, for example, is used as the fiber core 3. The fiber core 3 is configured by twisting together three core strands 2 and applying pressure from the outer circumference. Each of the core strands is constituted by a number of yarns that are formed by bundling synthetic fibers. In addition, rope grease is impregnated into the fiber core 3.

Each of the inner layer strands 4 is configured by twisting together a plurality of steel wires. In more detail, each of the inner layer strands 4 has a two-layer construction that has: a core wire 6 that is disposed centrally; and a plurality of (in this case, six) outer layer wires 7 that are twisted together on an outer circumference of the core wire 6. A diameter of the core wire 6 is similar or identical to a diameter of the outer layer wires 7.

A diameter of the inner layer strands 4 is smaller than a diameter of the outer layer strands 2. In this case, the diameter of the inner layer strands 4 is less than or equal to one third of the diameter of the outer layer strands 2. Furthermore, the inner layer strands 4 are greater in number than the outer layer strands 2. In this case, twelve inner layer strands 4 are used, compared to eight outer layer strands 2.

A resin that has a certain amount of hardness, such as polyethylene or polypropylene, for example, is used as a material for the inner layer rope coating body 5. The inner layer rope coating body 5 is interposed between adjacent outer layer strands 2, between adjacent inner layer strands 4, and also between the outer layer strands 2 and the inner layer strands 4.

Each of the outer layer strands 2 is configured by twisting together a plurality of steel wires. In more detail, each of the outer layer strands 2 has a three-layer construction that has: a core wire 8 that is disposed centrally; a plurality of (in this case, nine) intermediate wires 9 that are twisted together on an outer circumference of the core wire 8; and a plurality of (in this case, nine) outer layer wires 10 that are twisted together on an outer circumference of the layer of intermediate wires 9.

Diameters of the intermediate wires 9 are smaller than diameters of the core wire 8 and the outer layer wires 10. Diameters of the outer layer wires 10 are similar or identical to the diameter of the core wire 8. Furthermore, diameters of the wires 6 and 7 that constitute the inner layer strands 4 are smaller than the diameters of the wires 8 through 10 that constitute the outer layer strands 2.

In an elevator rope 28 of this kind, because the diameters of the inner layer strands 4 that are disposed on the outer circumference of the fiber core 3 are sufficiently smaller than the outer layer strands 2, sufficient cross-sectional area of the fiber core 3 can be ensured, enabling rope grease content to be sufficiently ensured.

Because the inner layer strands 4, which are greater in number than the outer layer strands 2, are disposed on the outer circumference of the fiber core 3, the fiber core 3 is protected by the inner layer strands 4 during molding of the inner layer rope coating body 5, preventing the fibers of the fiber core 3 from melting and breaking.

In addition, because the fiber core 3 is tightened when the inner layer strands 4 are twisted together, structural gaps inside the fiber core 3 are reduced significantly, enabling reductions in diameter due to deformation (loss of resilience) of the inner layer rope 1 over periods of extended use and increases in contact pressure between the outer layer strands 2 resulting therefrom to be prevented, thereby enabling wire abrasion of the outer layer strands 2 to be prevented. Thus, additional extension of service life of the elevator ropes 28 can be achieved.

Furthermore, because the fiber core 3 is disposed centrally, steel strands that are not twisted together with other strands do not exist. In other words, all of the strands 2 and 4 are twisted together with the other strands 2 and 4 without exception. Because of that, wire breakages and loosening of the wires 6 through 10 are less likely to occur, enabling extension of service life of the entire rope to be achieved.

If the rope grease inside the fiber core 3 dries up due to an extended period of use, loss of strength due to lubrication deteriorating and wire abrasion increasing between the inner layer rope 1 and the outer layer strands 2 can also be suppressed.

In addition, because cross-sectional area of the inner layer strands 4 is reduced, and unit mass of the rope is not increased unnecessarily, the present invention can be used instead of elevator ropes in existing elevator apparatuses, for example, without modification.

Increases in unit mass can be suppressed by reducing the diameter and increasing the number of inner layer strands 4 in this manner, but the construction of the rope is complicated compared to when the inner layer strands 4 are not used, and manufacturing costs are also increased.

In answer to that, by making the product of the number of wires and the number of strands seven times twelve, the configuration of the inner layer strands 4 is made relatively simple, and the total number of wires of the inner layer strands 4 is also kept down to eighty-four. Thus, an increases in unit mass due to the inner layer strands 4 can be kept to within 10 percent compared to if the portion occupied by the inner layer strands 4 were instead occupied by the fiber core 3.

If minute cracks arise in the inner layer rope coating body 5 due to an extended period of use, the rope grease is supplied to the outer layer strands 2 through the cracks. In contrast to that, if the thickness of the inner layer rope coating body 5 is too great, the rope grease may not be supplied, and the cross-sectional area of the fiber core 3 is reduced, also reducing rope grease pickup.

In order to prevent direct contact between the inner layer strands 4 and the outer layer strands 2, it is necessary for the inner layer rope coating body 5 to be interposed between the two. However, the thickness of the inner layer rope coating body 5 need only be in the order of one percent of the rope diameter in order to prevent direct contact. Because of that, allowing for manufacturing errors during coating application and laying of the outer layer strands 2, it is preferable for the thickness of the inner layer rope coating body 5 that is interposed between the inner layer strands 4 and the outer layer strands 2 to be greater than or equal to one percent and less than or equal to two percent of the overall diameter of the elevator rope 28.

By using a fiber core 3 that is made of a synthetic resin, gaps inside the fiber core 3 are reduced compared to natural fibers such as sisal that are commonly used as a core rope material in elevator ropes, further suppressing deformation (loss of resilience) over periods of extended use, and enabling corrosion in high-humidity environments to be suppressed. Thus, internal damage that was at risk of arising among the outer layer strands and between the outer layer strands 2 and the inner layer rope 1 can be more reliably prevented.

Moreover, the strength of the elevator rope 28 is basically designed so as to be able to support a load even without the inner layer strands 4. However, the tensile strength of the wires 6 and 7 that constitute the inner layer strands 4 may be set so as to be greater than tension of the wires 8 through 10 that constitute the outer layer strands 2 while making the diameters of the wires 6 and 7 that constitute the inner layer strands 4 smaller than the diameters of the wires 8 through 10 that constitute the outer layer strands 2. The inner layer strands 4 are thereby prevented from breaking at an earlier stage than the outer layer strands 2, such that wire breakages arise from the outer layer strands 2, facilitating determination of deterioration of the elevator rope 28 from external appearances.

Embodiment 2

Figure 3:
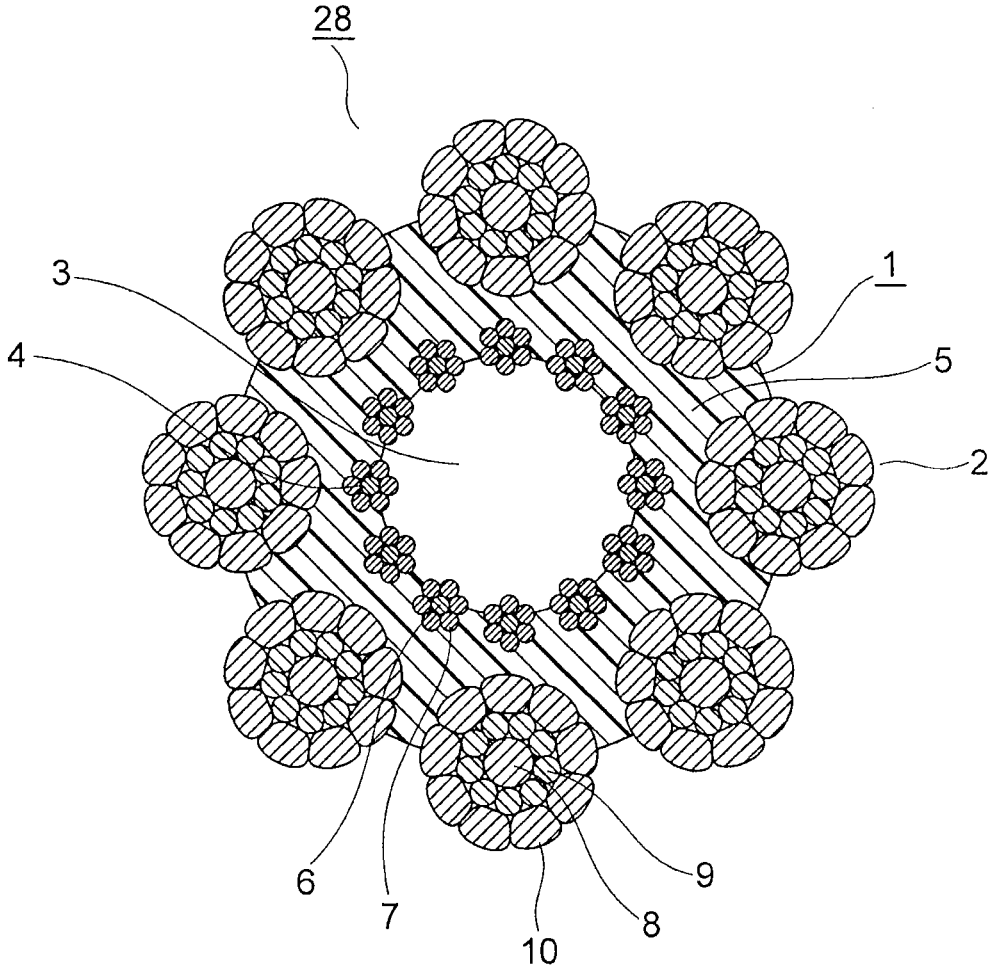
FIG. 3 is a cross section of an elevator rope according to Embodiment 2 of the present invention.

Next, FIG. 3 is a cross section of an elevator rope 28 according to Embodiment 2 of the present invention. In this example, outer layer strands 2 are compressed (by plastic working) from an outer circumference by a die during manufacturing. Cross-sectional shapes of outer layer wires 10 are thereby modified. The rest of the configuration is similar or identical to that of Embodiment 1.

According to a configuration of this kind, contact surface pressure between the rope grooves of the sheave 25 and the elevator rope 28 can be reduced, enabling damage to the outer layer strands 2 to be suppressed while suppressing internal damage to the elevator rope 28, and enabling additional extension of service life of the elevator rope 28 to be achieved.

Moreover, the type of elevator apparatus to which the elevator rope according to the present invention is applied is not limited to the type in FIG. 1. The present invention can also be applied to machine-roomless elevators, elevator apparatuses that use two-to-one (2:1) roping methods, multi-car elevators, or double-deck elevators, for example.

The elevator rope according to the present invention can also be applied to ropes other than ropes for suspending a car 29, such as compensating ropes or governor ropes, for example.

The invention claimed is:

1. An elevator rope comprising:

an inner layer rope that includes a fiber core; a plurality of steel inner layer strands that are twisted together on an outer circumference of the fiber core; and a resin inner layer rope coating body that is coated onto an entirety of the outer circumference of the fiber core having the plurality of steel inner layer strands twisted together on the outer circumference thereof; and a plurality of steel outer layer strands that are twisted together on an outer circumference of the inner layer rope such that the inner layer rope coating body is interposed between the inner layer strands and the outer layer strands over the entirety of the outer circumference of the fiber core having the plurality of steel inner layer strands twisted together on the outer circumference thereof, whereby the inner layer strands do not contact the outer layer strands, wherein:

a diameter of the inner layer strands is smaller than a diameter of the outer layer strands, and the inner layer strands are greater in number than the outer layer strands.

2. An elevator rope according to claim 1, wherein the diameter of the inner layer strands is less than or equal to one third of the diameter of the outer layer strands.

3. An elevator rope according to claim 1, wherein an increase in unit mass due to the inner layer strands is within 10 percent compared to if a portion occupied by the inner layer strands were instead occupied by the fiber core.

4. An elevator rope according to claim 1, wherein a thickness of the inner layer rope coating body that is interposed between the inner layer strands and the outer layer strands is greater than or equal to one percent and less than or equal to two percent of an overall rope diameter.

5. An elevator rope according to claim 1, wherein a rope grease is impregnated into the fiber core.

6. An elevator rope according to claim 1, wherein the fiber core is constituted by a synthetic fiber.

7. An elevator rope comprising:

an inner layer rope that includes:

a fiber core;

a plurality of steel inner layer strands that are twisted together on an outer circumference of the fiber core; and a resin inner layer rope coating body that is coated onto an outer circumference; and a plurality of steel outer layer strands that are twisted together on an outer circumference of the inner layer rope, wherein:

a diameter of the inner layer strands is smaller than a diameter of the outer layer strands, and the inner layer strands are greater in number than the outer layer strands, wherein a diameter of a wire that constitutes the inner layer strands is smaller than a diameter of any wire that constitutes the outer layer strands.

8. An elevator rope according to claim 1, wherein a tensile strength of a wire that constitutes the inner layer strands is greater than a tensile strength of any wire that constitutes the outer layer strands.

9. An elevator rope according to claim 1, wherein the outer layer strands are compressed from an outer circumference such that a cross-sectional shape of a wire on an outer circumference of the outer layer strands is modified thereby.

* * * * *